US009327534B2

(12) United States Patent
Souda

(10) Patent No.: US 9,327,534 B2
(45) Date of Patent: May 3, 2016

(54) IMAGE FORMING APPARATUS WITH A BEAM THAT ALIGNS A SHEET FEEDER WITH AN UPPER FRAME

(71) Applicant: Brother Kogyo Kabushiki Kaisha, Nagoya-shi, Aichi-ken (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/283,568

(22) Filed: May 21, 2014

(65) Prior Publication Data

US 2014/0253662 A1 Sep. 11, 2014

Related U.S. Application Data

(63) Continuation of application No. 13/050,024, filed on Mar. 17, 2011, now Pat. No. 8,768,237.

(30) Foreign Application Priority Data

Apr. 22, 2010 (JP) ..... 2010-098467

(51) Int. Cl.
*G03G 15/00* (2006.01)
*B41J 29/02* (2006.01)
(Continued)

(52) U.S. Cl.
CPC ..... *B41J 29/02* (2013.01); *G03G 15/234* (2013.01); *G03G 15/6502* (2013.01);
(Continued)

(58) Field of Classification Search
CPC ..... G03G 21/1619; G03G 2221/1678; G03G 2221/1684; G03G 2215/00383; G03G 15/6502; G03G 15/6579; G03G 15/234; B65H 2401/231; B65H 2402/32; B65H 2401/40; B65H 2401/44
See application file for complete search history.

(56) References Cited

U.S. PATENT DOCUMENTS 5,055,885 A * 10/1991 Yoshikado et al. ..... 399/401
5,191,382 A * 3/1993 Okamura et al. ..... 399/107
(Continued)

FOREIGN PATENT DOCUMENTS

CN 1952810 A 4/2007
JP 10-072174 3/1998
(Continued)

OTHER PUBLICATIONS

Non Final Office Action issued in U.S. Appl. No. 13/050,024 mailed Apr. 11, 2013.
(Continued)

*Primary Examiner* — Justin Olamit
(74) *Attorney, Agent, or Firm* — Banner & Witcoff, Ltd.

(57) ABSTRACT

An image forming apparatus is provided. The image forming apparatus includes an image forming unit, a return-sheet conveyer unit to convey a recording sheet carried from the image forming unit along a return-sheet path to return to the image forming unit, an upper frame unit including a pair of side frames to support the image forming unit in a position there-between, and a pair of lower frames arranged to have a predetermined amount of clearance there-between to have the return-sheet conveyer unit in the clearance, and configured to be less rigid than the upper frame unit and to support lower sections of the pair of side frames. A vertical position of the return-sheet conveyer unit with respect to the image forming unit is defined with reference to the upper frame unit by having a part of the return-sheet conveyer unit aligned to be in contact with the upper frame unit.

6 Claims, 6 Drawing Sheets

(51) Int. Cl.
*G03G 15/23* (2006.01)
*G03G 21/16* (2006.01)

(52) U.S. Cl.
CPC ..... *G03G 15/6579* (2013.01); *G03G 21/1619* (2013.01); *B65H 2401/231* (2013.01); *B65H 2402/32* (2013.01); *B65H 2402/40* (2013.01); *B65H 2402/44* (2013.01); *G03G 2215/00383* (2013.01); *G03G 2221/1678* (2013.01); *G03G 2221/1684* (2013.01)

(56) References Cited

U.S. PATENT DOCUMENTS

| | | | | |
|---|---|---|---|---|
| 5,666,595 | A * | 9/1997 | Sameshima et al. | 399/110 |
| 6,322,264 | B1 * | 11/2001 | Osmus et al. | 400/624 |
| 8,265,518 | B2 * | 9/2012 | Kondo | 399/107 |
| 2008/0080890 | A1 | 4/2008 | Uto et al. | |
| 2008/0175638 | A1 | 7/2008 | Murayama | |
| 2010/0014887 | A1 * | 1/2010 | Tomatsu et al. | 399/107 |
| 2010/0158596 | A1 | 6/2010 | Inoue | |

FOREIGN PATENT DOCUMENTS

| | | | |
|---|---|---|---|
| JP | 2001-166550 | | 6/2001 |
| JP | 2002-145464 | A | 5/2002 |
| JP | 2003-036015 | A | 2/2003 |

OTHER PUBLICATIONS

Final Office Action received in U.S. Appl. No. 13/050,024 mailed Oct. 9, 2013.
Notice of Allowance issued in U.S. Appl. No. 13/050,024 mailed Feb. 27, 2014.
First Office Action in counterpart Chinese Application No. 201110090822.X, mailed Jul. 22, 2013, along with its English translation.
JP Notification of Reasons for Rejection dated Feb. 28, 2012, corresponding Application No. 2010-098467; English Translation.

* cited by examiner

IMAGE FORMING APPARATUS WITH A BEAM THAT ALIGNS A SHEET FEEDER WITH AN UPPER FRAME

CROSS REFERENCE TO RELATED APPLICATIONS

This application is a continuation of U.S. application Ser. No. 13/050,024, filed Mar. 17, 2011, which claims priority from Japanese Patent Application No. 2010-098467, filed on Apr. 22, 2010, the entire subject matter of which is incorporated herein by reference.

BACKGROUND

1. Technical Field

An aspect of the present invention relates to an image forming apparatus, which is capable of forming images on a recording sheet.

2. Related Art

A printer capable of forming images on either side of a sheet of recording medium (e.g., paper) is known. In order to have images formed on both sides of the sheets (i.e., double-face printing), for example, the printer may convey the sheet in an image forming unit to form an image on a first side of the sheet and further convey the sheet in a return-sheet conveyer unit, which conveys the sheet to return to the image forming unit in a reversed orientation so that an image is formed on a second side of the sheet.

For another example, a printer having a lower frame, in which a sheet-feeder unit is arranged, and an upper frame, in which an image forming unit is arranged, is known. In the printer, the lower frame is designed to be less rigid than the upper frame so that the lower frame can be deformed more easily to absorb stress, which may be caused by being placed on an uneven or stepped area. In this configuration, the upper frame, which holds the image forming unit and is more sensitive to the uneven stress, may be released from the stress and maintained stably with a smaller amount of deformation. Therefore, misalignment of the image forming unit within a chassis of the printer can be reduced, and image-forming quality of the printer may be maintained. Further, weight and manufacturing cost of the printer may be reduced, compared to a printer having the lower frame, which is designed to be as rigid as the upper frame. Thus, the printer can be handled easily and manufactured cost-efficiently.

SUMMARY

In the above-mentioned printers, however, when the return-sheet conveyer unit is arranged in the lower frame, the return-sheet conveyer unit may be misaligned, specifically in a vertical direction, with respect to the image forming unit arranged in the upper frame due to the deformation of the lower frame. When the return-sheet conveyer unit is misaligned with respect to the image forming unit, a returning-sheet path, which connects the image forming unit with the return-sheet conveyer unit and in which the sheet leaving the image forming unit is conveyed to return to the image forming unit once again, may not be secured. When the returning-sheet path is rough, the sheet may not be supplied to the image forming unit correctly. In other words, it is desirable that the return-sheet conveyer unit is placed in a vertically and horizontally correct position with respect to the image forming unit whilst the return-sheet conveyer and the image forming unit are held by different frames.

In view of the above deficiencies, the present invention is advantageous in that an image forming apparatus, which is capable of maintaining a return-sheet conveyer unit in a vertically correct position with respect to an image forming unit, is provided.

According to an aspect of the present invention, an image forming apparatus is provided. The image forming apparatus includes an image forming unit, which is configured to form an image on a recording sheet, a return-sheet conveyer unit, which is configured to convey the recording sheet carried from the image forming unit along a return-sheet path to return to the image forming unit, an upper frame unit, which includes a pair of side frames and is configured to support the image forming unit in a position between the pair of side frames, and a pair of lower frames, which are arranged to have a predetermined amount of clearance there-between and to have the return-sheet conveyer unit in the clearance, and are configured to be less rigid than the upper frame unit and to support lower sections of the pair of side frames. A vertical position of the return-sheet conveyer unit with respect to the image forming unit is defined with reference to the upper frame unit by having at least a part of the return-sheet conveyer unit aligned to be in contact with the upper frame unit.

BRIEF DESCRIPTION OF THE ACCOMPANYING DRAWINGS

DETAILED DESCRIPTION

Figure 1:
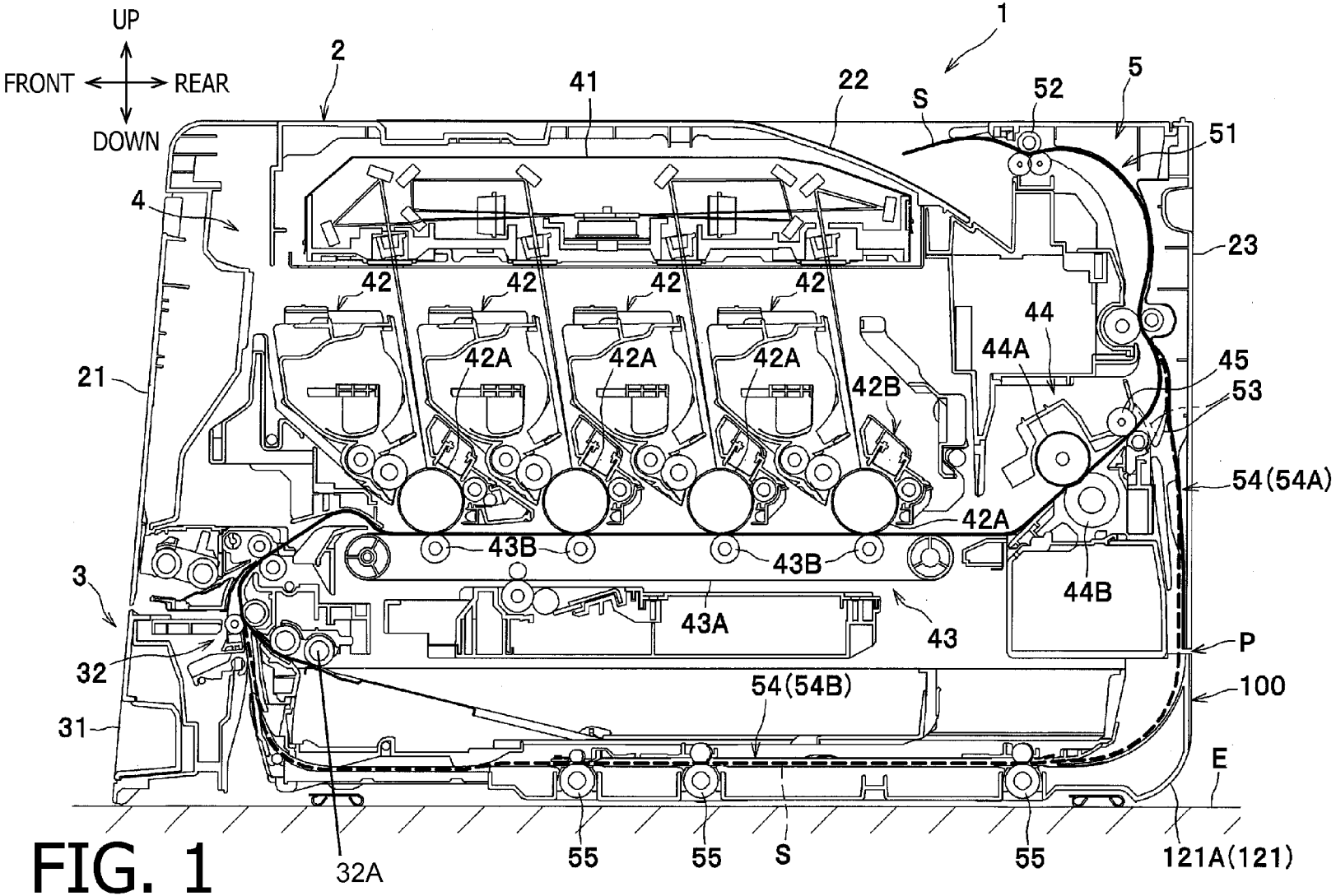
FIG. 1 is a cross-sectional side view of a color printer according to an embodiment of the present invention.

Hereinafter, a configuration of a color printer 1 according to an embodiment of the present invention will be described with reference to the accompanying drawings. In the present embodiment, directions concerning the color printer 1 will be referred to in accordance with orientation as indicated by arrows in each drawing. Therefore, for example, a viewer's left-hand side appearing in FIG. 1 is referred to as a front side of the color printer 1, and a right-hand side in FIG. 1 opposite from the front side is referred to as rear. A side which corresponds to the viewer's nearer side is referred to as left, and an opposite side from the left, which corresponds to the viewer's further side is referred to as right. The up-down direction in FIG. 1 corresponds to a vertical direction of the color printer 1. Further, the right-left direction of the color printer 1 may be referred to as a widthwise direction, and the front-rear direction may be referred to as a direction of depth. The widthwise direction and the direction of depth are perpendicular to each other. Furthermore, directions of the drawings in FIGS. 2-7 are similarly based on the orientation of the color printer 1 as defined above and correspond to those with respect to the color printer 1 shown in FIG. 1 even when the drawings are viewed from different angles.

Overall Configuration of the Color Printer

The color printer 1 (see 1) is a multicolor laser printer capable of printing double-faces, in which images can be formed on both sides of a recording sheet S. The color printer 1 is settled on a surface E (e.g., a tabletop) and includes a chassis 2, a feeder unit 3, an image forming unit 4, and a conveyer unit 5.

The feeder unit 3 is arranged in a lower section in the chassis 2 and includes a sheet-feed tray 31, which accommodates the sheet S to be supplied to the image forming unit 4, and a sheet feeder 32 including sheet feeder roller 32A, which picks up the sheet S from the sheet-feed tray 31 and conveys the picked-up sheet S to the image forming unit 4.

The image forming unit 4 forms an image on a surface of the sheet S and includes an exposure unit 41, a plurality of (e.g., four) processing units 42, a transfer unit 43, and a fixing unit 44.

The exposure unit 41 is arranged in an upper section in the chassis 2 and includes a laser-beam source (not shown), a plurality of polygon mirrors (unsigned), lenses (unsigned), and a plurality of reflection mirrors (unsigned). Laser beams emitted from the laser-beam source for a plurality of (e.g., four) colors are reflected on the polygon mirrors and the reflection mirrors and transmit through the lenses to be casted to scan on surfaces of photosensitive drums 42A.

The processing units 42 are aligned in line along a direction of depth (i.e., a front-rear direction) of the color printer 1, and includes the photosensitive drums 42A, a charger 42B, developer rollers (unsigned), supplier rollers (unsigned), flattener blades (unsigned), and toner containers (unsigned) to contain toner therein. All the processing units 42A are configured similarly but different from one another in colors of the toner contained in the toner containers.

The transfer unit 43 is arranged between the sheet-feed tray 31 and the processing units 42. The transfer unit 43 includes a driving roller (unsigned), a driven roller (unsigned), an endless carrier belt 43A, which is arranged to roll around the driving and driven rollers, and a plurality of (e.g., four) transfer rollers 43B. The carrier belt 43A is arranged to have an upper outer surface thereof to become in contact with the four photosensitive drums 42A. Further, the four transfer rollers 43B are arranged in positions opposite from the photosensitive drums 42A across the carrier belt 43A, and the carrier belt 43A is in contact with the four transfer rollers 43B on an upper inner surface thereof.

The fixing unit 44 is arranged in a rear position with respect to the processing units 42 and includes a heat roller 44A and a pressure roller 44B. The pressure roller 44B is arranged in a position opposite from the heat roller 44A across a sheet path and presses the sheet S being conveyed in the sheet path against the heat roller 44A.

In each of the processing units 4 configured as above, the charger 42B electrically charges a surface of the photosensitive drum 42A evenly, and the surface of the photosensitive drum 42A is exposed to the laser beam emitted based on image data from the exposure unit 41 in order to form a lower-potential regions, i.e., an electrostatic latent image representing the image to be formed on the sheet S, thereon. Meanwhile, the toner in the toner container is supplied to the supplier roller and to the developer roller and flattened by the flattener blade evenly on a surface of the developer roller.

The toner is supplied to the latent image on the photosensitive drum 42A from the developer roller. Thus, the latent image is developed to be a toner image and carried on the surface of the photosensitive drum 42A. When the sheet S supplied from the feeder unit 3 is carried on the carrier belt 43A to a position between the photosensitive drum 42A and the transfer roller 43B, the toner image formed on the surface of the photosensitive drum 42A is transferred onto the sheet S. Thus, four colored images are sequentially overlaid on the surface of the sheet S to form a colored image.

The sheet S with the transferred toner images is carried to a nipped section between the heat roller 44A and the pressure roller 44B in the fixing unit 44 to have the toner images thermally fixed thereon. The sheet S with the fixed image is ejected out of the chassis 2 by discharge roller 45 along a conveyer path 51 and settled in a discharge tray 22.

The conveyer unit 5 carries the sheet S discharged from the image forming unit 4 either outside the chassis 2 or to the image forming unit 4 once again. The conveyer unit 5 includes the conveyer path 51, the discharge roller 52, a flap 53, which is swingable in the front-rear direction, a return-sheet path 54, and conveyer rollers 55, which convey the sheet S in the return-sheet path 54 toward the image forming unit 4.

The conveyer path 51 partially coincides with the sheet path, along which the sheet S with the formed image is conveyed to be ejected out of the chassis 2. The conveyer path 51 extends in a rear section in the chassis 2 vertically. More specifically, the conveyer path 51 rises vertically from vicinity of the flap 53 being in a rear position (as indicated in a solid line in FIG. 1) and curves at an upper rear section in the chassis 2 to direct the sheet S frontward.

The discharge roller 52 is rotatable in two directions: a normal rotation direction and a reverse rotation direction. When in the normal rotation, the discharge roller 52 directs the sheet S discharged from the image forming unit 4 outward outside the chassis 2. When in the reverse rotation, the discharge roller 52 directs the sheet S inward inside the chassis 2. Further, when the discharge roller 52 rotates in the normal direction to eject the sheet S, the flap 53 is placed in the rear position to open the conveyer path 51.

The return-sheet path 54 extends vertically in the rear section of the chassis and horizontally in a lower section underneath the sheet-feed tray 31. More specifically, the return-sheet path 54 extends from vicinity of the flap 53 being in a front position (as indicated in a broken line in FIG. 1) and curves at a lower rear section in the chassis 2 to direct the sheet S frontward. The return-sheet path 54 further extends underneath the sheet-feed tray 31 horizontally and curves upwardly to direct the sheet S to the sheet feeder 32. Thus, the return-sheet path 54 includes a vertical section 54A extending downwardly from the vicinity of the flap 53 and a frontward-conveying section 54B extending horizontally and upwardly. The vertical section 54A and the frontward-conveying section 54B are connected at a rear section of the color printer 1, wherein a cover section 120 of the return-sheet conveyer unit 100 and a rear cover 23 of an upper frame unit 210 are aligned. The cover section 120 and the upper frame unit 210 with the rear cover 23 will be described later in detail. When the discharge roller 52 rotates in the reverse direction to convey the sheet S in the return-sheet path 54, the flap 53 is placed in the front position to open the return-sheet path 54.

When the sheet S is completed with image forming, the conveyer unit 5 conveys the sheet S from the image forming unit 4 in the conveyer path 51 to eject out of the chassis 2 by the normal rotation of the discharge roller 52. The ejected sheet S is settled in the discharge tray 22. When image forming is incomplete with the sheet S, that is, an image is completed on one side of the sheet S and another image is yet to be formed on the other side of the sheet S, the sheet S is reversed within the chassis 2 so that the sheet S is processed again in the image forming unit 4 in the reversed orientation. Therefore, the sheet S leaving the image forming unit 4 is carried in the conveyer path 51, and, before the sheet S is completely ejected out of the chassis 2, the rotating direction of the discharge roller 52 is reversed so that the sheet S is withdrawn in the opposite direction inwardly and directed in the return-sheet path 54 to the sheet feeder 32, as indicated by a thick broken line in FIG. 1. Thus, the sheet S is returned to the image forming unit 4 in the reverse orientation.

When the sheet S is completed with image forming, that is, when the image is formed on the reversed side, the conveyer unit 5 conveys the sheet S from the image forming unit 4 in the conveyer path 51 to eject out of the chassis 2 by the normal rotation of the discharge roller 52. The ejected sheet S is settled in the discharge tray 22.

Positioning Mechanism of Return-Sheet Conveyer Unit

A configuration of a return-sheet conveyer unit 100 and a positioning mechanism to place the return-sheet conveyer unit 100 in a correct position will be described hereinbelow.

A frame structure of the color printer 1 will be described with reference to FIG. 2. The chassis 2 of the color printer 1 includes an upper frame unit 210 and a pair of lower frames 220. The upper frame unit 210 has the exposure unit 41, the processing units 42, the transfer unit 43, and the fixing unit 44 fixed thereto directly or via intervening components (not shown). The upper frame unit 210 includes a pair of side frames 211, a scanner frame 212, and crossing beams 213, 214.

The side frames 211 are metal plates, which are arranged along a left side and a right side in the color printer 1 to have a predetermined amount of clearance there-between so that the image forming unit 4 is arranged in the clearance. An image of the image forming unit 4 is omitted in FIG. 2.

The scanner frame 212 and the crossing beams 213, 214 are made of metal and arranged to connect the side frames 221 with one another and extend perpendicularly to the side frames 221. The scanner frame 212 and the crossing beams 213, 214 are fixed to the side frames 211 in, for example, welding and/or by screws.

The scanner frame 212 is a frame member, on which the exposure unit 41 is placed and fixed thereat. The scanner frame 212 is formed to have a plurality of linear slits (unsigned), through which the laser beams emitted from the exposure unit 41 are allowed to transmit, along the right-left direction.

The crossing beam 213 is formed to have a shape of hollow rectangular prism and is embedded in a lower rear section of the side frames 211. The crossing beam 213 includes contact areas 213A in a bottom surface thereof, which confront contact portions 122 of the return-sheet conveyer unit 100. The contact portions 122 will be described later in detail.

The lower frames 220 are a pair of resin frames, which are arranged along the left side and the right side in the color printer 1 to have a predetermined amount of clearance there-between so that the return-sheet conveyer unit 110 and the sheet-feed tray 31 are arranged in the clearance. Images of the return-sheet conveyer unit 110 and the sheet-feed tray 31 are omitted in FIG. 2. The lower frames 220 are arranged in the color printer 1 to have the side frames 211 of the upper frame unit 210 placed on top thereof. Thus, the side frames 211 are held by the lower frames 220 at bottom sections thereof.

The lower frames 220 made of resin are thus inherently less rigid than the upper frame unit 210 made of metal. More specifically, the lower frames 220 are designed to be substantially rigid to hold the side frames 211 from the bottoms but less rigid than the upper frame unit 210 by, for example, being formed to be thinner or having a smaller number of reinforcing members there-between.

Due to the rigidity difference between the upper frame unit 210 and the lower frames 220, the lower frames 220 can be more easily deformed, when the color printer 1 is settled in an uneven or stepped area, to absorb the unevenness so that deformation of the upper frame unit 210 is reduced.

Each of the lower frames 220 is provided with a guide rail 221, which protrudes inward from an inner surface of the lower frame 220 and extends horizontally in the (front-rear) direction of depth, to guide the return-sheet conveyer unit 100 in between the lower frames 220 when the return-sheet conveyer unit 100 is installed in the color printer 1. Further, each of the lower frames 220 is formed to have a screw hole (unsigned) on a rear surface 222 thereof. The return-sheet conveyer unit 110 is attached to the lower frames 220 via the screw holes by bolts B. The lower frames 220 are connected to each other by a front beam 231 and a rear beam 232, which extend along the widthwise (right-left) direction.

The chassis 2 of the color printer 1 according to the present embodiment is configured to have the upper frame unit 210 on the lower frames 220, and the upper frame unit 210 and the lower frames 222 being covered by a resin shell (not shown). A front cover 21 (see FIG. 1) of the chassis 2 and a front surface of the sheet-feed tray 31 constitute an exterior front surface of the color printer 1. Further, a rear cover 23 of the chassis 2 and a rear surface (a cover 121) of the return-sheet conveyer unit 100 constitute an exterior rear surface of the color printer 1 (see FIG. 3).

Figure 2:
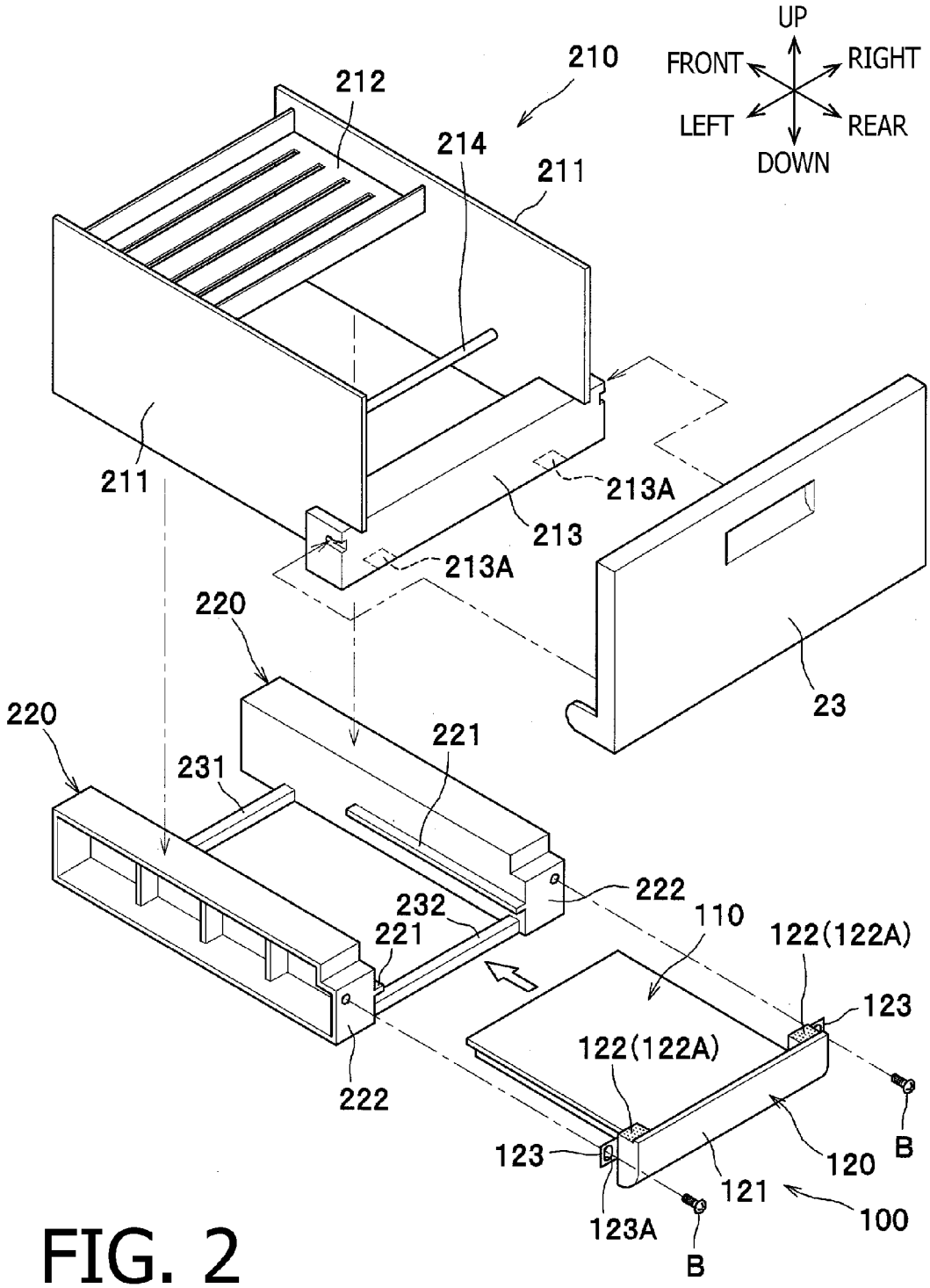
FIG. 2 is an exploded view of a frame assembly in the color printer according to the embodiment of the present invention.
Figure 3:
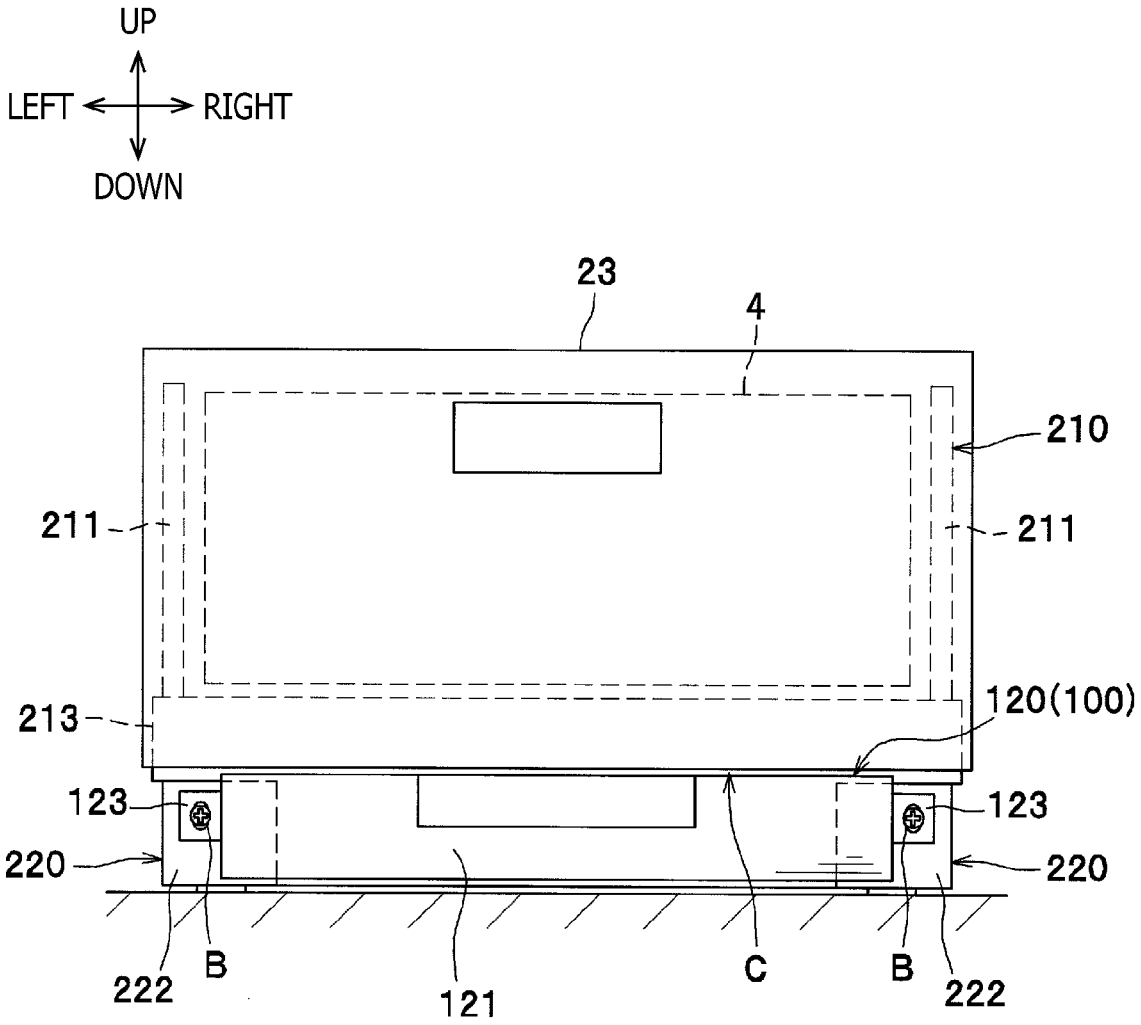
FIG. 3 illustrates a rear view of the color printer according to the embodiment of the present invention.
Figure 4:
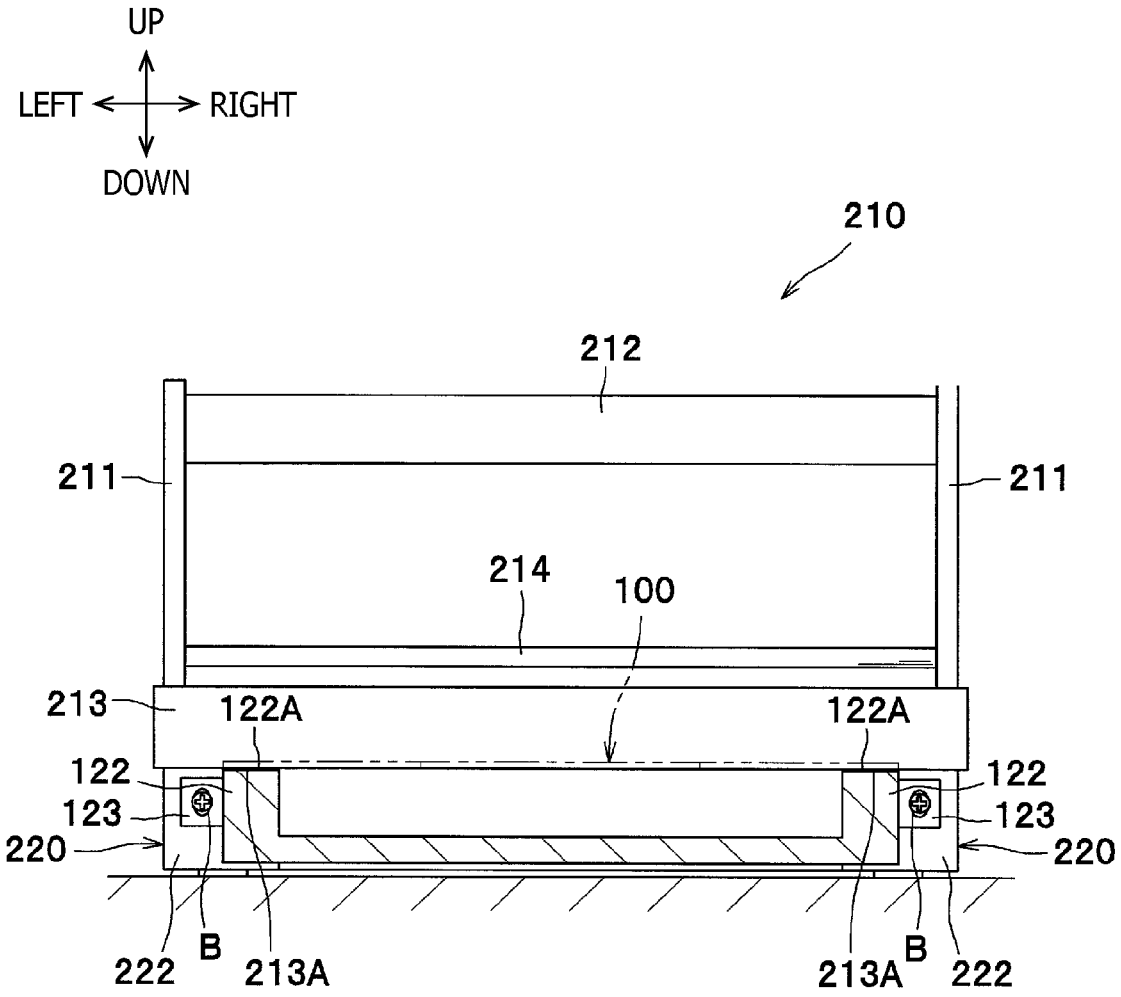
FIG. 4 illustrates a mechanism for vertically positioning a return-sheet conveyer unit in the color printer according to the embodiment of the present invention.

The rear cover 23 is an upper cover supported by the upper frame unit 210 to cover a rear side of the image forming unit (i.e., an upper rear section of the color printer 14) (see FIGS. 2 and 3). In particular, the rear cover 23 is attached to the crossing beam 213 and arranged in a correct position with respect to the upper frame unit 210 with reference to the crossing beam 213.

A configuration of the return-sheet conveyer unit 100 will be described with reference to FIGS. 1-3 in detail.

The return-sheet conveyer unit 100 is arranged in a lower section with respect to the sheet-feed tray 31 and includes the frontward-conveying section 54B of the return-sheet path 54 (see FIG. 1). The return-sheet conveyer unit 100 is provided with a plurality of conveyer rollers 55 along a horizontal section of the frontward-conveying section 54B. Rotation of the conveyer rollers 55 conveys the sheet S, which is carried from the sheet path 51 by the reverse rotation of the discharge roller 52, to return to the image forming unit 4.

The return-sheet conveyer unit 100 includes a conveyer section 110 and a cover section 120 (see FIGS. 2 and 3). The conveyer section 110 includes a part of the forward-extending section 54B and the plurality of conveyer rollers 55. The cover section 120 is arranged in a rear section of the return-sheet conveyer unit 100 and includes a cover 121, which partially defines the exterior rear surface of the color printer 1, a pair of contact portions 122, and a pair of fixing tabs 123. According to the present embodiment, the rear section of the return-sheet conveyer unit 100 corresponds to an inlet side of the forward-conveying section 54B, in which the vertical section 54A of the return-sheet path 54 meets the frontward-conveying section 54B of the return-sheet path 54. The frontward-conveying section 54B is connected with the vertical section 54A at an inlet point P (see FIG. 1) on the inlet side, and the sheet S carried along the vertical section 54A is drawn in the forward-extending section 54B through the inlet point P.

The cover 121 is a lower cover to cover the side of the return-sheet conveyer unit 100 closer to the inlet point P. The cover 121 is arranged in a lower position with respect to the rear cover 23, when the return-sheet conveyer unit 100 is installed in the chassis 2, and in a position adjacent to the rear cover 23 with a predetermined amount of clearance C maintained there-between. Thus, the rear cover 23 and the cover 121 constitute the exterior rear surface of the color printer 1. The cover 121 is formed to have an inwardly-curved lower section 121A, which is curved frontward toward a downstream side along a direction of sheet-conveyance in the return-sheet conveyer unit 100 (see FIG. 1).

The contact portion 122 is formed on each of a right-side end and a left-side end of the cover section 120. A top surface 122A of the contact portion 122 confronts and becomes in contact with the contact areas 213A of the crossing beam 213 when the return-sheet conveyer unit 100 is installed in the chassis 2. The top surface 122A is indicated by hatching in FIG. 2.

The fixing tabs 123 being thin plates protrude outward (rightward and leftward) from an edge of the contact portions 122. Each of the fixing tabs 123 is formed to have a vertically elongated hole 123A. When the return-sheet conveyer unit 100 is set in the chassis 2, the return-sheet conveyer unit 100 is fixed to rear planes 222 of the lower frames 220 via the fixing tabs 123 by the bolts B.

Next, a mechanism to install the return-sheet conveyer unit 100 in a correct position in the color printer 1 will be described.

When the return-sheet conveyer unit 100 is installed, the upper frame unit 210 is placed on the pair of lower frames 220 to be fixed thereat (see FIG. 2). In this regard, due to weight of the upper frame unit 210, the lower frames 220 are depressed and deformed vertically to an extent, and a vertical level of the upper frame unit 210 is slightly lowered.

With the upper frame unit 210 in the lowered position and the lower frames 220 deformed, the return-sheet conveyer unit 100 is set in the position between the lower frames 220. More specifically, the return-sheet conveyer unit 100 is placed in the clearance between the lower frames 220 with right and left edges of a bottom plane of the conveyer section 110 supported by the guide rails 221 of the lower frames 220. The return-sheet conveyer unit 100 is slidably pushed frontward therefrom along the guide rails 221 (see FIG. 5).

The return-sheet conveyer unit 100 is pushed frontward until the fixing tabs 123 come into contact with the rear planes 222 of the lower frames 220. In this regard, due to the upper frame unit 210 being in the lowered position on the deformed lower frames 220, the top surfaces 122A of the contact portions 122 become in contact with the bottom surface of the crossing beam 213 of the upper frame unit 210 (see FIG. 4). In other words, the return-sheet conveyer unit 100 being in the position between the lower frames 220 can become in contact with the crossing beam 213 of the upper frame unit 210 at the top surfaces 122A of the contact portions 122. Thus, the return-sheet conveyer unit 100 is set in a vertically correct position with respect to the upper frame unit 210. In this regard, a top edge of the cover 121 is lower than the level of the top surfaces 122A; therefore, the clearance C can be maintained between the cover 121 and the rear cover 23 when the return-sheet conveyer unit 100 is installed in between the lower frames 220.

The return-sheet conveyer unit 100 set in the vertically correct position is fixed to the rear planes 222 of the lower frames 220 via the fixing tabs 123 by the bolts B. In this regard, the elongated shape of the holes 123A in the fixing tabs 123 allows the return-sheet conveyer unit 100 to be vertical adjustable with respect to the lower frames 220 within a range of height of the holes 123A. Therefore, when the return-sheet conveyer 100 is placed in the position between the lower frames 220, but the top surfaces 122A of the contact portions 122 do not reach the bottom surface of the crossing beam 213, due to, for example, insufficient deformation of the lower frames 220, a user may adjust the vertical position of the return-sheet conveyer unit 100 within the height of the holes 123A in order to have the top surfaces 122A of the contact portions 122 to be in contact with the bottom surface of the crossing beam 123. Once the position of the return-sheet conveyer 100 is adjusted, the user may tighten the bolts B to fix the return-sheet conveyer 100 thereat.

Figure 5:
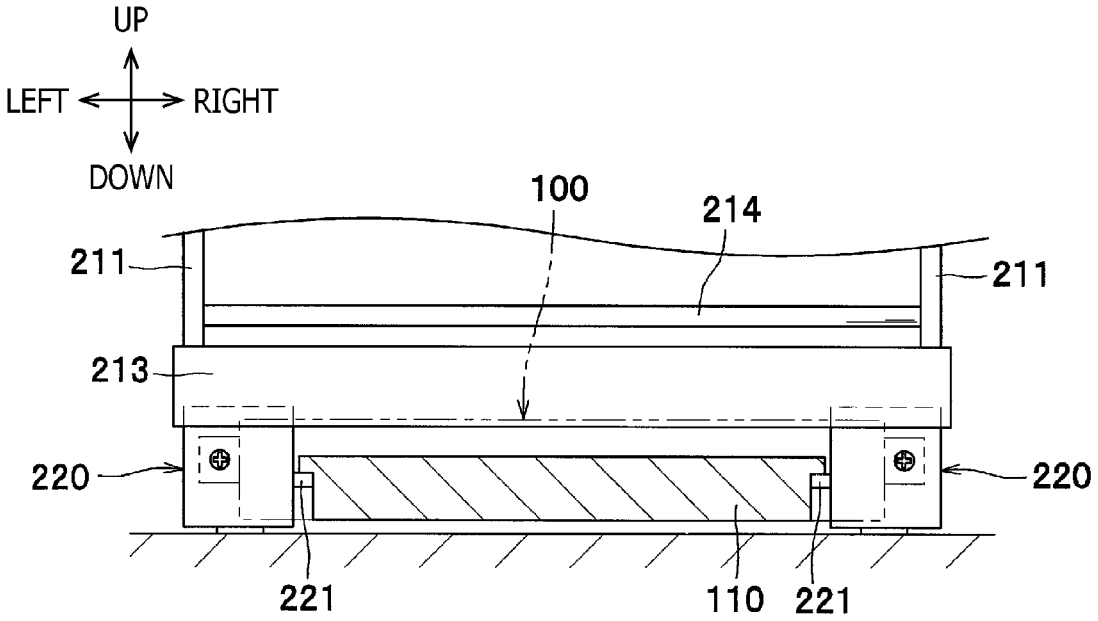
FIG. 5 illustrates a mechanism for horizontally (right-left) positioning the return-sheet conveyer unit in the color printer according to the embodiment of the present invention.
Figure 6:
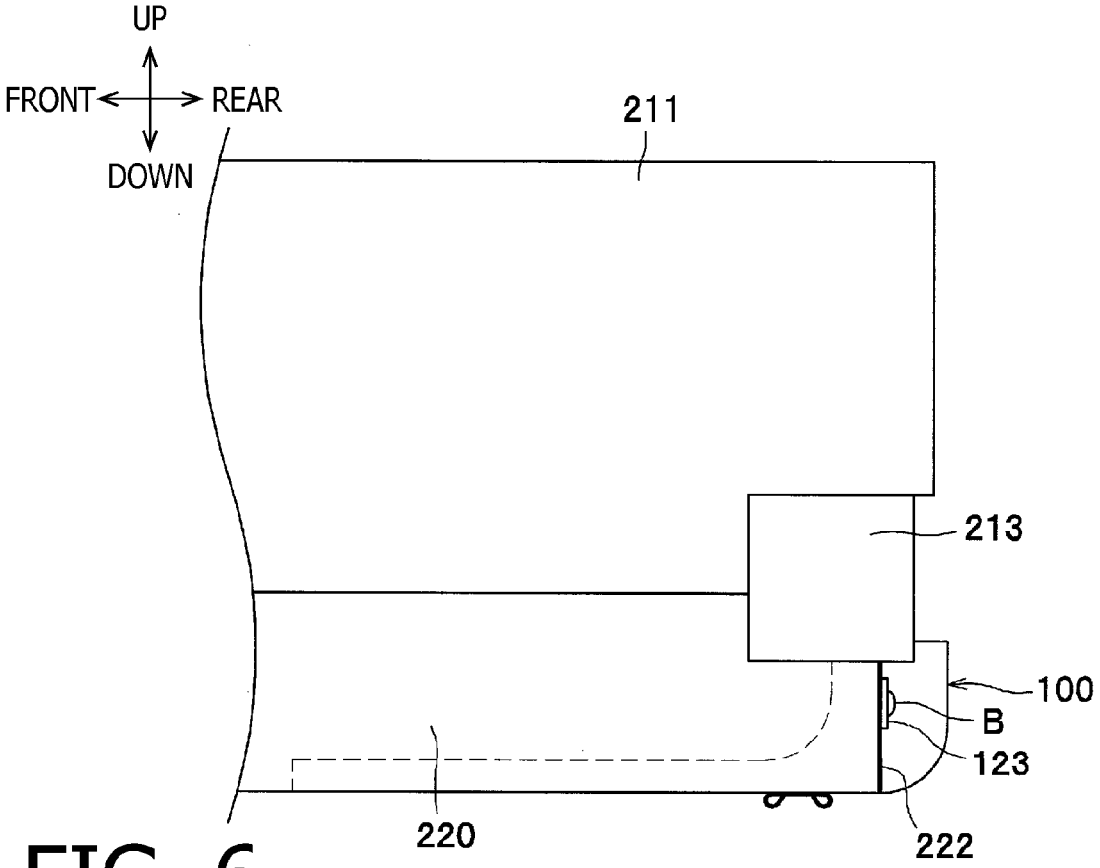
FIG. 6 illustrates a mechanism for horizontally (front-rear) positioning a return-sheet conveyer unit in the color printer according to the embodiment of the present invention.
Figure 7A:
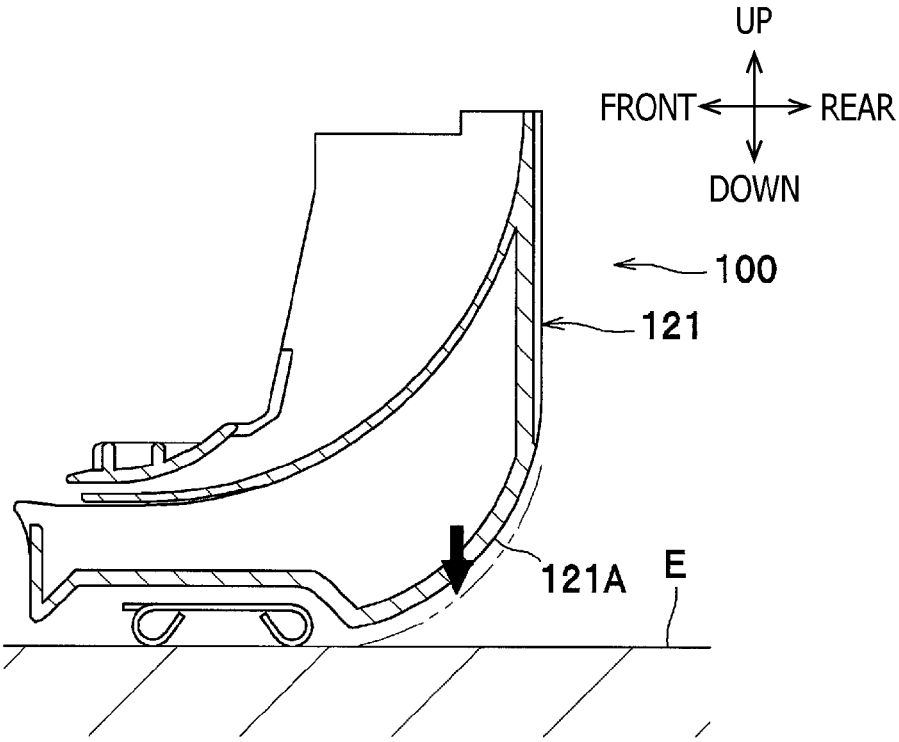
FIG. 7A illustrates the return-sheet conveyer unit having a curved lower section in a cover in the color printer according to the embodiment of the present invention.
Figure 7B:
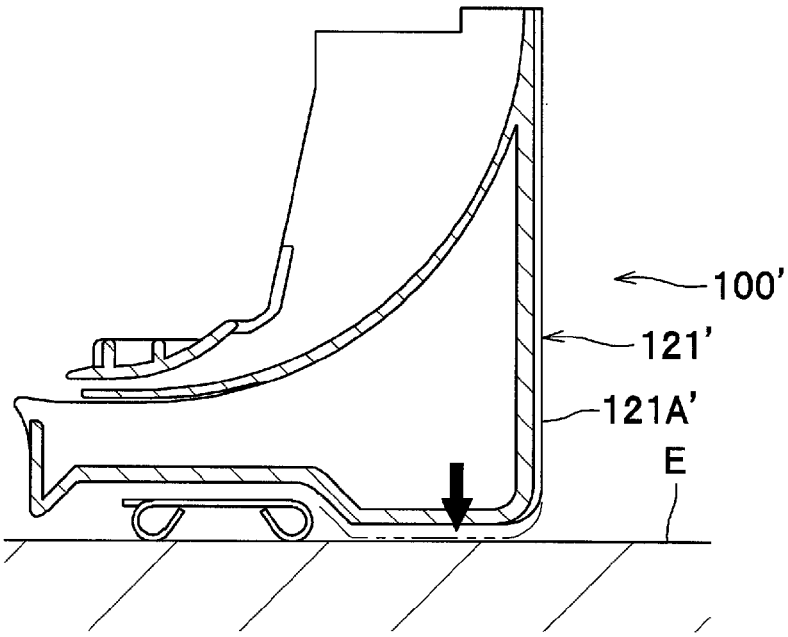
FIG. 7B illustrates a comparative example of a return-sheet conveyer unit.

Meanwhile, a position of the return-sheet conveyer unit 100 in the widthwise (right-left) direction is defined by the guide rails 221, which have the conveyer section 110 interposed there-between (see FIG. 5). Further, a position of the return-sheet conveyer unit 100 in the (front-rear) direction of depth is determined by the fixing tabs 123 being in contact with the rear planes 222 of the lower frames 220 (see FIG. 6). Thus, the horizontal position of the return-sheet conveyer unit 100 in the widthwise direction and the direction of depth is determined with reference to the lower frames 220.

According to the present embodiment, the return-sheet conveyer unit 100 can be set in the vertically correct position with respect to the upper frame unit 210 by having the top surfaces 122A of the contact portions 122 aligned to the crossing beam 213 of the upper frame unit 210. Thus, the return-sheet conveyer unit 100 can be set in the vertically correct position with respect to the image forming unit 4, which is supported by the upper frame unit 210. Therefore, the sheet S carried from the image forming unit 4 can be stably and correctly carried to the return-sheet conveyer unit 100.

According to the present embodiment, further, the lower frames 220 are designed to be less rigid than the upper frame unit 210. Therefore, when the color printer 1 is placed on an uneven or stepped area, the lower frames 220 are more easily deformable to absorb the stress caused by the unevenness so that deformation of the upper frame unit 210, which is more deformation-sensitive, is reduced. Thus, misalignment of the image forming unit 4 within the upper frame unit 4, which may be caused by the deformation, can be reduced. In other words, deterioration of image-forming quality of the color printer 1 may be prevented. Further, compared to a printer having rigid lower frames, which are as rigid as an upper frame unit, weight and manufacturing cost of the color printer 1 according to the present embodiment can be reduced.

In the present embodiment, the return-sheet conveyer unit 100 is placed in the vertically correct position with reference to the crossing beam 213 of the upper frame unit 210. Meanwhile, the vertical section 54A and the frontward-conveying section 54B of the return-sheet path 54 are connected at the rear section (i.e., the inlet side) of the return-sheet conveyer unit 100. Therefore, the frontward-conveying section 54B of the return-sheet path 54 is correctly connected with the vertical section 54A of the return-sheet path 54 at the rear section so that the sheet S carried from the image forming unit 4 can be smoothly and correctly forwarded through the inlet point P to the return-sheet path 54 in the return-sheet conveyer unit 100.

Further, the rear cover 23 of the upper frame unit 210 and the cover 121 of the return-sheet conveyer unit 100 are both set in the positions with reference to the relatively rigid upper frame unit 210; therefore, the positional relation between the rear cover 23 and the cover 121 can be correctly maintained.

When the positional relation between the rear cover 23 and the cover section 120 are correctly maintained, the clearance C (see FIG. 3) between the rear cover 23 and the cover 121 can be steadily maintained, and, whilst the rear cover 23 and the cover 121 constitute the exterior rear surface of the color printer 1, exterior appearance of the color printer 1 can be maintained even when the lower frames 220 are deformed.

Furthermore, whilst the cover 121 is formed to have the inwardly-curved lower section 121A, the exterior appearance of the color printer can be improved to be better than a color printer having a cover which extends vertically to the surface E without the curvature. For example, if a return-sheet conveyer unit 100' (see FIG. 7B) has a lower section 121A' extending perpendicularly to the surface E, and when the lower frames 220 are deformed and the position of the entire color printer 1 is lowered, deformation of clearance between the cover 121' and the surface E due to the deformation of the lower frames 220 may be obvious to a user, and the user may find the deformation obtrusive. With the inwardly-curved lower section 121A in the cover 121, on the other hand, deformation of the clearance may be masked to be inapparent even when the lower frames 220 are deformed and the position of the entire color printer 1 is lowered (see FIG. 7A). Thus, the exterior appearance of the color printer can be improved by the curvature of the cover 121.

According to the present embodiment, the horizontal position of the return-sheet conveyer unit 110 in the widthwise direction and the direction of depth is determined with reference to the lower frames 220. Thus, the return-sheet conveyer unit 100 can be set in the correct position by the simple methods, such as interposing the conveyer section 110 between the guide rails 221 of the lower frames 220 and aligning the fixing tabs 123 to the rear planes 222 of the lower frames 220.

According to the present embodiment, since the lower frames 220 are affected by the weight of the upper frame unit 210 and the components supported by the upper frame unit 210 and by the stress caused by the unevenness of the surface E, the lower frames 220 are designed to absorb the stress in the vertical direction. In this reason, the lower frames 220 are designed to deform such that amount of horizontal deformation in the widthwise right-rear direction and the front-rear direction of depth is restricted to be smaller than an amount of the deformation in the vertical direction. Therefore, even when the positions of the return-sheet conveyer unit 100 in the right-left direction and front-rear direction are determined with reference to the deformable lower frames 220, the sheet S may still be substantially stably carried in the return-sheet path 54.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

The horizontal position of the return-sheet conveyer unit 100 in the widthwise direction and the direction of depth may not necessarily be determined with reference to the lower frames 220, but at least one of the positions of the return-sheet conveyer unit 100 in the widthwise direction and the direction of depth may be determined with reference to the upper frame unit 210. For example, a pair of frames (e.g., the side frames 211) in the upper frame unit 210 may be formed to have downwardly-extending sections, and the return-sheet conveyer unit 100 may be supported by the downwardly-extending sections. In this way, the position of the return-sheet conveyer unit 100 in the widthwise direction may be determined with reference to the upper frame unit 210. Further, the return-sheet conveyer unit 100 may be fixed to the downwardly-extending sections by bolts so that the return-sheet conveyer unit 100 may be set in the correct position also in the direction of depth. When the positions of the return-sheet conveyer unit 100 are determined with reference to the more rigid upper frame unit 210, the return-sheet conveyer unit 100 may be more stably set in the correct position with respect to the image forming apparatus, which is held by the upper frame unit 210.

For another example, the vertical position of the return-sheet conveyer unit 100 may not necessarily be determined by having a part (i.e., the top surfaces 122A of the contact portions 122) of the return-sheet conveyer unit 100 aligned to be in contact with the upper frame unit 210. But the vertical position may be determined, for example, by having an entire upper section of the return-sheet conveyer unit aligned to be in contact with a bottom of the upper frame unit 210.

For another example, further, the lower section 121A of the cover 121 may not necessarily be inwardly-curved but may be formed linearly.

For another example, furthermore, the return-sheet conveyer unit 100 may not necessarily be arranged in the lower position with respect to the sheet-feed tray 31 but may be arranged in a higher position with respect to the sheet-feed tray 31, for example, in between the sheet-feet tray 31 and the image forming unit 4.

Further, some of the components in the image forming unit 4 may be replaced with different components. For example, the photosensitive drums 42A may not necessarily be exposed to the laser beams, but the light source to expose the photosensitive drums 42A to the laser beams may be replaced with an LED (light emitting diode), an EL (electro-luminescence), or a phosphor. For another example, the fixing unit 44 with the heat roller 44A and the pressure roller 44B may be replaced with a fixing unit with a film fusing mechanism.

For another example, the chassis 2 of the color printer 1 may have a front cover, which constitutes an exterior surface of the color printer 1.

The embodiment described above may not necessarily be applied to a multicolor printer but may be employed in, for example, a monochrome printer, a copier, or a multifunction peripheral device.

Further, the sheet S may not necessarily be paper but may be, for example, an OHP sheet.

What is claimed is:

1. An image forming apparatus, comprising:

an image forming unit configured to form an image on a recording sheet;

a feeder unit configured to supply the recording sheet to the image forming unit, the feeder unit comprising a first positioning portion on a top surface thereof;

an upper frame unit comprising a pair of side frames, the upper frame unit being configured to support the image forming unit in a position between the pair of side frames, the upper frame unit comprising a positioning part, the positioning part being configured to be in contact with the first positioning portion of the feeder unit and configured to define a position of the feeder unit along a vertical direction;

a pair of lower frames configured to be less rigid than the upper frame unit and to support lower sections of the upper frame unit, the pair of lower frames being arranged to be spaced apart from one another, the pair of lower frames comprising guide rails, the guide rails being configured to guide the feeder unit to a position between the pair of lower frames, the guide rails guiding the feeder unit to place the part of the feeder unit into contact with the positioning part as the feeder unit is set in an installed position in the image forming apparatus; and a sheet feeder roller configured to pick up the recording sheet and convey the picked-up recording sheet to the image forming unit, the sheet feeder roller being disposed in a position displaced from the positioning part at least along a direction orthogonal to a vertical direction, wherein the feeder unit further comprises a second positioning portion in a different position from the first positioning portion, the second positioning portion being configured to contact the pair of lower frames and define a position of the feeder unit with respect to pair of the lower frames along the direction orthogonal to the vertical direction.

2. The image forming apparatus according to claim 1, wherein at least a part of the feeder unit is arranged in a position to overlap the image forming unit along the vertical direction;

wherein the feeder unit comprises a cover, the cover forming a part of an exterior surface of the image forming apparatus;

wherein the positioning part and the cover are arranged on a same side with respect to the image forming unit along a direction orthogonal to the vertical direction.

3. The image forming apparatus according to claim 1, further comprising:

an upper cover, the upper cover being supported by the upper frame unit to cover a side of the image forming unit.

4. The image forming apparatus according to claim 1, wherein the upper frame unit comprises a beam, the beam being configured to connect the pair of side frames with one another; and wherein the positioning part is formed in the beam.

5. The image forming apparatus according to claim 1, wherein the feeder unit is a return-sheet conveyer unit configured to convey the recording sheet with the image formed thereon once again to the image forming unit.

6. The image forming apparatus according to claim 1, wherein a positional relation between the positioning part and the part of the feeder unit is maintained while the recording sheet is supplied to the image forming unit.

* * * * *